US007377819B1

(12) United States Patent
Cooper et al.

(10) Patent No.: US 7,377,819 B1
(45) Date of Patent: May 27, 2008

(54) METHOD AND APPARATUS FOR IMPROVING NETWORK CONNECTION SECURITY WITH ONE OR MORE CROSS-WIRED ADAPTERS

(75) Inventors: Gregory Cooper, Las Cruces, NM (US); David R. Gorman, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 0 days.

(21) Appl. No.: 11/530,717

(22) Filed: Sep. 11, 2006

Related U.S. Application Data

(60) Provisional application No. 60/795,996, filed on Apr. 27, 2006.

(51) Int. Cl.
*H01R 24/00* (2006.01)

(52) U.S. Cl. ..... 439/676

(58) Field of Classification Search ..... 439/676, 439/76.1, 620.19, 660, 678, 679, 941
See application file for complete search history.

(56) References Cited

U.S. PATENT DOCUMENTS

| | | | | |
|---|---|---|---|---|
| 4,781,626 | A | 11/1988 | Lazarchik | |
| 5,305,380 | A | 4/1994 | Hileman et al. | |
| 5,310,363 | A * | 5/1994 | Brownell et al. | 439/676 |
| 5,370,541 | A | 12/1994 | Bossard | |
| 5,425,172 | A * | 6/1995 | Carswell et al. | 29/884 |
| 5,432,484 | A * | 7/1995 | Klas et al. | 333/1 |
| 5,618,185 | A * | 4/1997 | Aekins | 439/76.1 |
| 5,931,703 | A * | 8/1999 | Aekins | 439/676 |
| 6,302,741 | B1 * | 10/2001 | Fasold et al. | 439/620.19 |
| 6,554,650 | B2 | 4/2003 | Kayworth et al. | |
| 6,848,947 | B2 * | 2/2005 | Chimiak | 439/676 |
| 6,851,957 | B1 | 2/2005 | Bhogal et al. | |
| 6,960,025 | B2 | 11/2005 | Gurreri | |
| 7,033,227 | B2 * | 4/2006 | Karir | 439/676 |
| 7,036,144 | B2 | 4/2006 | Welcher et al. | |
| 2002/0083337 | A1 | 6/2002 | Welcher et al. | |
| 2002/0126960 | A1 | 9/2002 | Gurreri | |
| 2005/0191010 | A1 | 9/2005 | Gurreri et al. | |
| 2005/0206474 | A1 | 9/2005 | Huang | |
| 2006/0063436 | A1 | 3/2006 | Gurreri et al. | |

FOREIGN PATENT DOCUMENTS

WO WO 99/45611 9/1999

OTHER PUBLICATIONS

"8" Crossover Cat5e Adapter, http://www.cyberguys.com/templates/searchdetail.asp?T1=120+6138, (Jun. 4, 2006).
"Creating a small Ethernet network", http://docs.info.apple.com/article/html?artnum=1-6658, (Jan. 16, 2002).
"How to do a Simple PC Network", http://www.integratorpro.com/archives/Sep'02.html, (Sep. 2002).

* cited by examiner

*Primary Examiner*—Chandrika Prasad
(74) *Attorney, Agent, or Firm*—Justin R. Jackson; Deborah A. Peacock; Peacock Myers, P.C.

(57) ABSTRACT

A method and apparatus for improving network connection security. An adapter having a cross-wiring section which alters the pin out of the network from a standard wiring pattern to a non-standard wiring pattern is preferably connected to two or more connection points for the network.

13 Claims, 8 Drawing Sheets

METHOD AND APPARATUS FOR IMPROVING NETWORK CONNECTION SECURITY WITH ONE OR MORE CROSS-WIRED ADAPTERS

CROSS-REFERENCE TO RELATED APPLICATIONS

This application claims priority to and the benefit of the filing of U.S. Provisional Patent Application Ser. No. 60/795,996, entitled "Secure Cross Jack", filed on Apr. 27, 2006, and the specification thereof is incorporated herein by reference.

BACKGROUND OF THE INVENTION

1. Field of the Invention (Technical Field)

The present invention relates to methods and apparatuses for improving security of a network, particularly for improving security of an ethernet or other computer network.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Prior art devices directed toward improving local area network connection security rely primarily on physical characteristics of one or more connectors. See for example, U.S. Pat. No. 6,960,025, to Gurreri; U.S. Patent Application No. 2002/0126960, to Gurreri; and U.S. Patent Application Nos. 2005/0191010; and 2006/0063436, Gurreri et al. These known devices change the shape of the connector, such that standard cables and connectors cannot be used to successfully connect a computer or other electronic device to the secured network. Because prior art devices prevent the use of standard components with a network, the cost and labor required to implement those systems is significant.

Another prior art device for securing a telecommunications port is described by Hileman et al. in U.S. Pat. No. 5,305,380. The Hileman et al. device is a small plug that can be inserted into an unused port. The plug blocks physical access to a port and requires a key to remove the plug. One of the problems with the plug and key invention of Hileman et al. is that a plug must be inserted into every un-used port. As such, each time that a user disconnects his or her electronic device from a telecommunications system, the user must also obtain and insert a Hileman et al. plug. Further, if a system has several Hileman et al. plugs in use, each user will need to be issued a key or must otherwise have access to a key. Further, users of the Hileman et al. plug must either ensure that all of the plugs are keyed the same or must otherwise keep track of numerous keys. Still further, because the Hileman et al. plug relies on providing a physical barrier to the contacts of an electrical jack, a person wishing to subvert the purpose of the Hileman et al. device can simply remove the entire electrical jack from the wall and wire that person's electronic device directly into the existing electrical line.

There is thus a need for a method and apparatus which can simply and effectively protect a network and which further can protect a network without the expenditure of a significant amount of time and money.

BRIEF SUMMARY OF THE INVENTION

An embodiment of the present invention relates to a network security apparatus for connecting a computer or other electronic device to a network having a predetermined or standard wiring pattern, the apparatus including a first adapter which itself has a plug section, a socket section, and a cross-wiring section. The adapter also preferably has a wiring pattern of the socket section altered from the standard or predetermined wiring pattern of the network wiring pattern. The apparatus can also have a second adapter, and the second adapter can have a plug section, a socket section, and a cross-wiring section. Optionally, the cross-wiring section of the second adapter can have a wiring pattern which is the inverse of the cross-wiring section of the first adapter.

In addition, the first adapter can be disposed between a switch and/or a patch panel and the network wiring. The second adapter can be disposed between a second computer or other electronic device and the network wiring. The plug section of the first adapter and/or the second can be an RJ-45 eight-wire plug.

The plug section and the socket section can optionally be of a same connector series. Alternatively, the plug section and said socket section can also not be of a same connector series. The first adapter can have a visible identifier.

An embodiment of the present invention also relates to a method for enhancing the security of a network including altering a wiring pattern at a first end of a network from a standard or predetermined wiring pattern to a non-standard or non-predetermined wiring pattern, and altering a wiring pattern at a second end of the network from the non-standard or non-predetermined wiring pattern to a standard or predetermined wiring pattern. In the method, altering a wiring pattern at a first end can include installing a first adapter having a cross-wiring section. Altering a wiring pattern at a second end can include installing a second adapter having a cross-wiring section which is inverse to the cross-wiring section of the first adapter.

An embodiment of the present invention also relates to a method of enhancing the security of an existing network including intentionally installing a first adapter which alters the wiring pattern of the existing network to a non-standard and/or non-predetermined wiring pattern. The method can also include installing a second adapter at a connection point of the network which alters the non-standard wiring pattern to a standard wiring pattern. In the method, the first adapter can include a cross-wiring section. As in an apparatus embodiment of the present invention, first adapter and/or the second adapter used in the method can also include an RJ-45 eight-wire plug and/or socket. In the method, the first adapter and second adapter can be of the same connector series.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The term "controlled network", as used throughout the specification and claims means any electrical network which is distributed through an adapter or combination of adapters of the present invention and which thus requires at least one corresponding inverse adapter for a computer or other electrical device to be able to communicate through the network.

The term "connector series", as used throughout the specification and claims includes a plug and a socket combination wherein the plug comprises outside dimensions and configurations which permit the plug to be inserted into a socket of the same connector series. As such, for example, an RJ-45 eight-wire socket is within the same connector series as a RJ-45 eight-wire plug, even if the RJ-45 eight-wire socket and plug are physically rigidly connected back-to-back such that the plug cannot actually be inserted into the attached socket.

Figure 1:
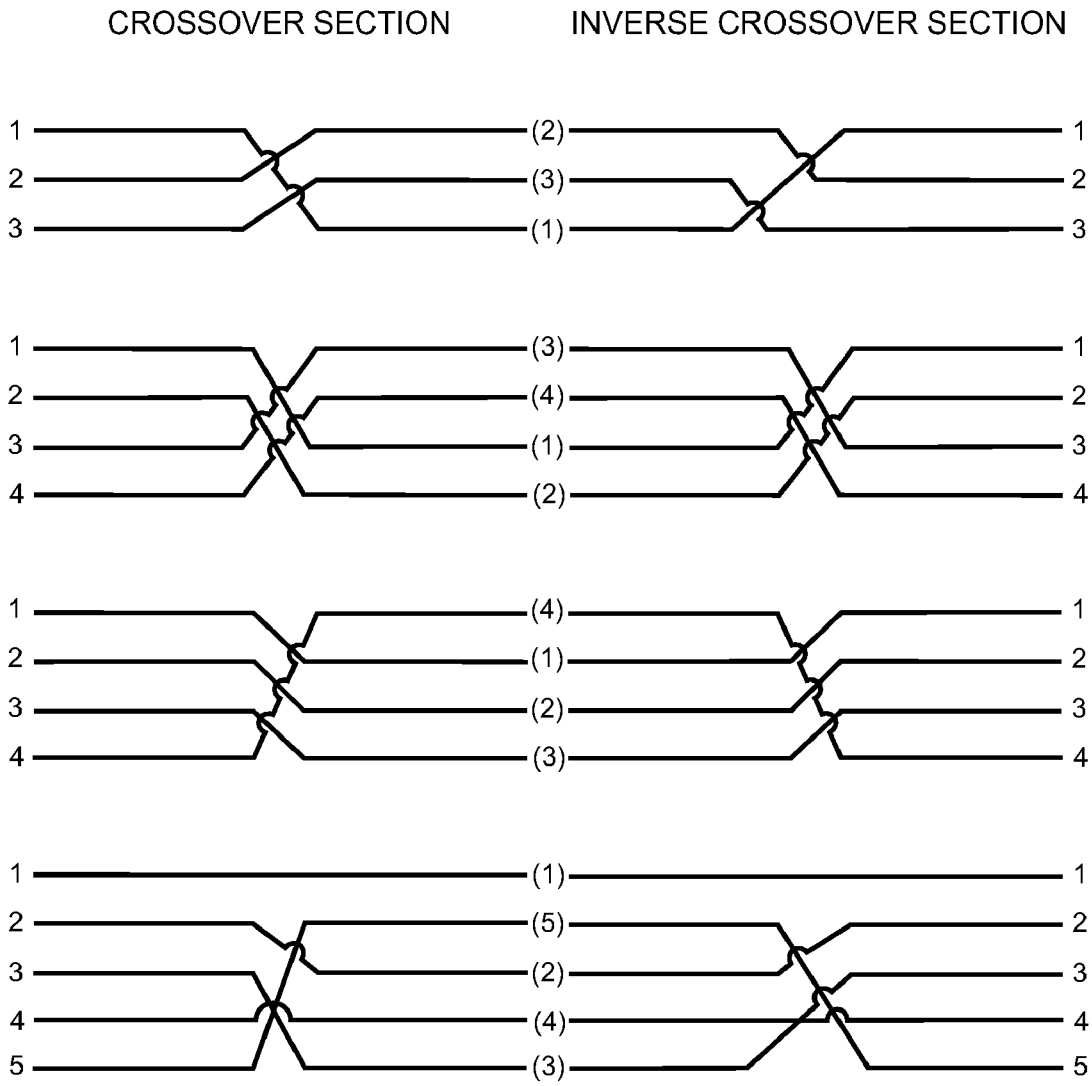
FIG. 1 is a drawing illustrating a few cross-wiring configurations and corresponding inverse cross-wiring configurations for each.

The term "inverse" as used throughout the specification and claims is meant to include a cross-wiring configuration which results in the original wiring pattern being rendered. See FIG. 1 for a few examples of cross-wiring configurations and corresponding "inverse" cross-wiring configurations. As such, an "inverse" cross-wiring configuration can have a configuration which is identical to the cross-wiring configuration of the original cross-wiring, or if necessary, it can have a different cross-wiring configuration as is necessary for the two cross-wiring configurations to negate one another and thus result in the original wiring pattern being rendered. Although only symmetrically cross-wired adapters have an inverse which is identical to the original adapter, adapters of the present invention can be caused to operate with an inverse connector which is non-identically cross-wired, if the non-identically cross-wired adapter is connected back-to-back or front-to-front with the original adapter and the original wiring pattern is returned after the second adapter and the term "inverse" is intended to cover such an arrangement.

In addition to the various meanings and definitions attributed to the term "socket", as used throughout the specification and claims, the term "socket" further includes a device, apparatus, structure, item, and/or thing, capable of accepting a cable and/or individual conductors thereof.

Although several of the figures and various portions of the specification of the present application illustrate and/or refer to a RJ-45 connector, the present invention can be used with virtually any type of network connection wherein a plurality of conductors are used and the present invention is thus not to be limited to RJ-45 connectors.

An embodiment of the present invention relates to an apparatus for (and corresponding method of) improving network security. Although the embodiments of present invention can be used with virtually any electronic network, the preferred embodiment of the present invention is preferably used in conjunction with Ethernet networks using RJ-45 connectivity.

Figure 2:
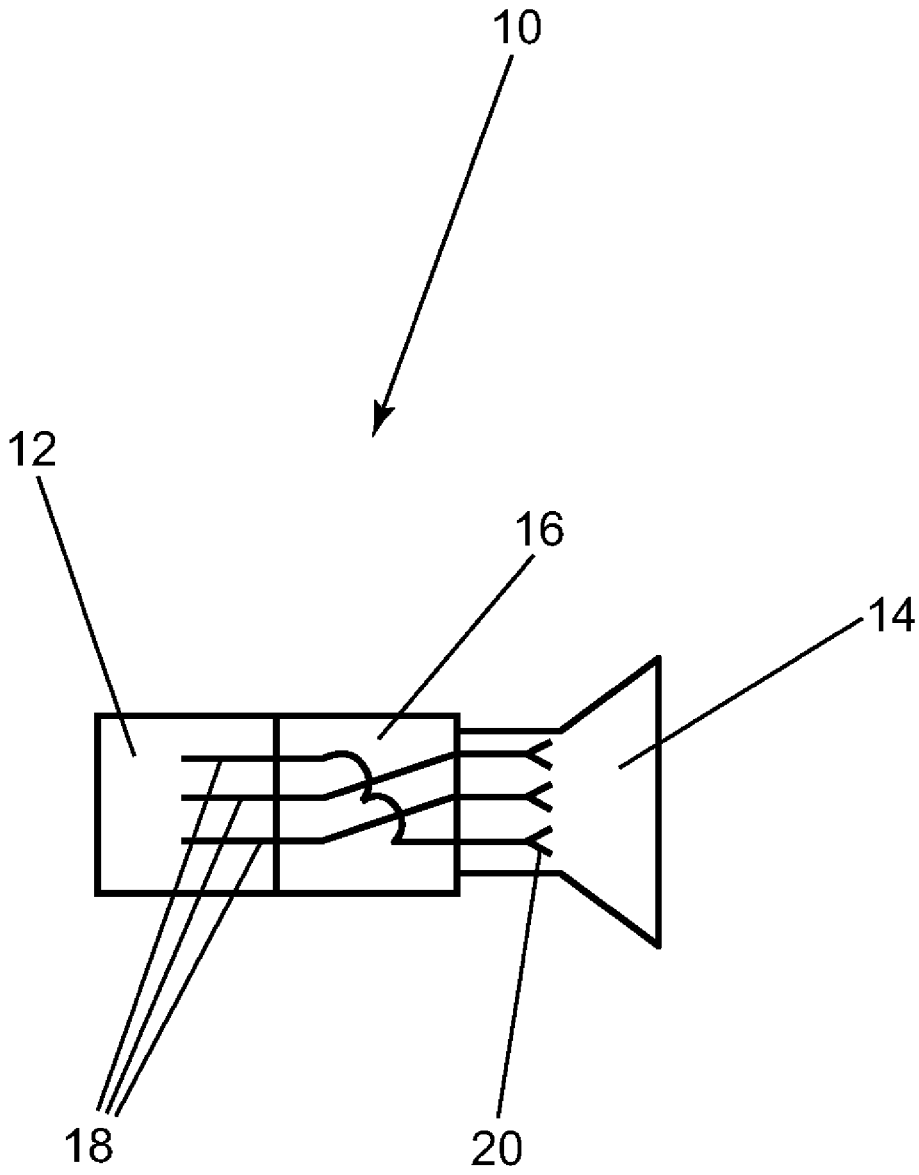
FIG. 2 is a drawing illustrating an embodiment of a single adapter of the present invention.
Figure 3:
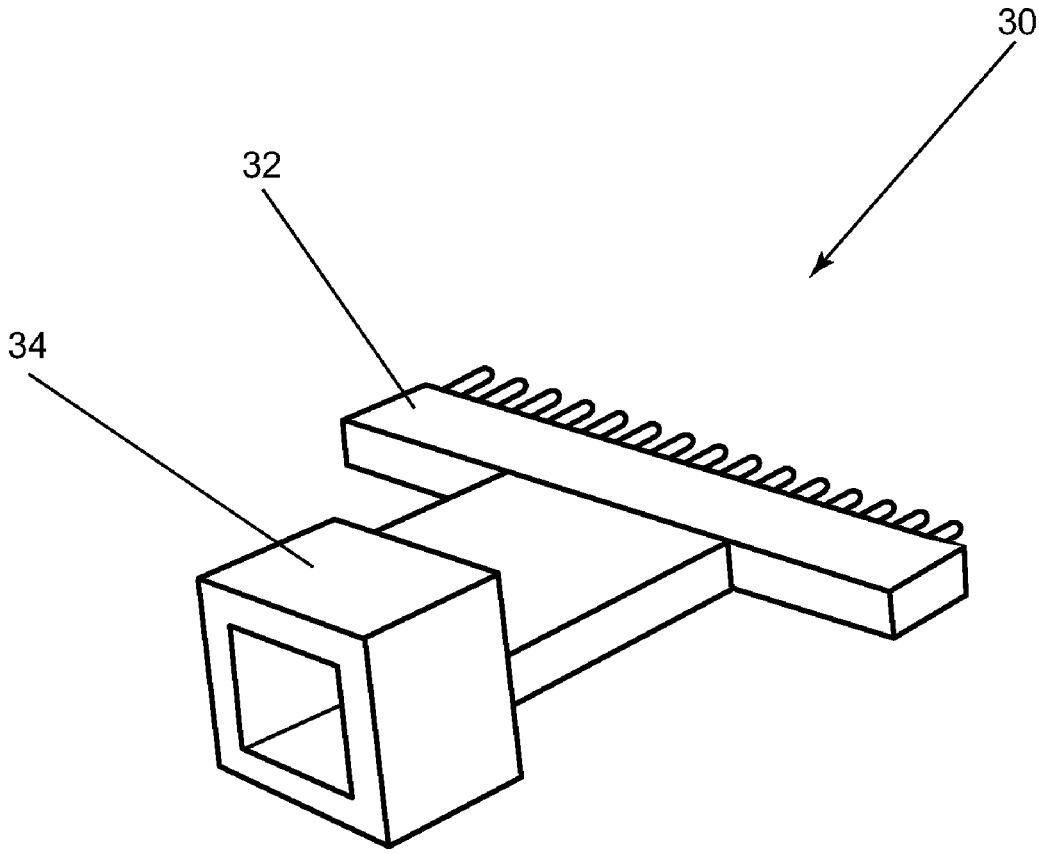
FIG. 3 is a drawing illustrating an embodiment of the present invention wherein the socket and the plug of an adapter are not of the same connector series.

FIG. 2 illustrates an embodiment of the present invention. As illustrated therein, adapter 10 preferably comprises plug 12 disposed on a proximal end and socket 14 disposed on a distal end. Adapter 10 further preferably comprises cross-wiring section 16. Plug 12 preferably comprises a plurality of electrical connectors 18, which are preferably in a male-type configuration and which are designed to be received by corresponding electrical receptacles 20 which are preferably housed within a female-type socket. Although, in one embodiment, socket 14 is within the same connector series as plug 12, the plug 12 and socket 14 of adapter 10 need not necessarily be from the same connector series. For example, as illustrated in FIG. 3, adaptor 30 can comprise plug 32 which is not within the same connector series as socket 34.

Figure 4:
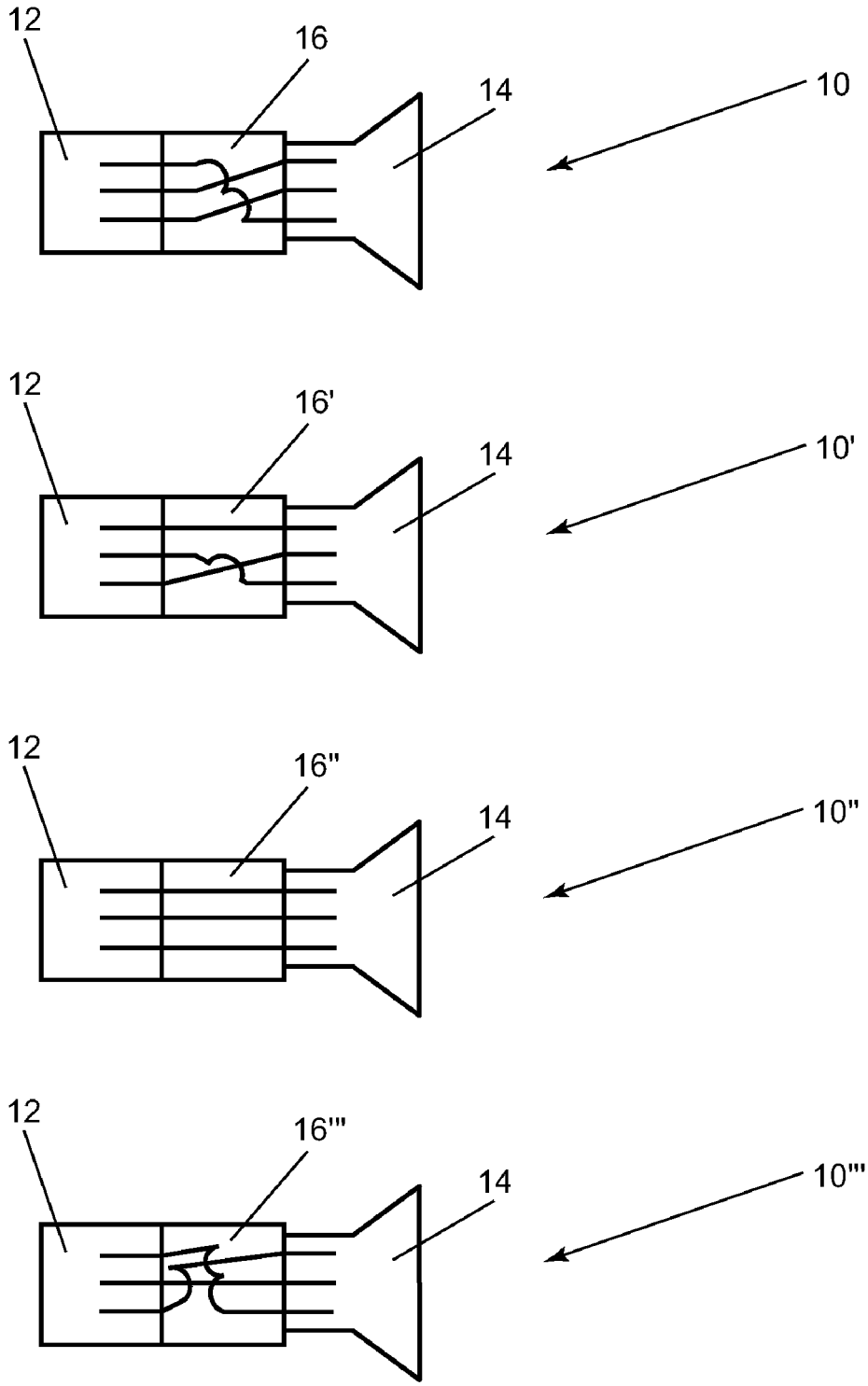
FIG. 4 is a drawing illustrating embodiments of the present invention wherein the cross-wiring section is altered such that different electrical configurations are created.

Referring to FIG. 4, multiple embodiments of the present invention can be created when plug 12 and socket 14 remain constant, but cross-wiring section 16 is modified by changing the electrical cross-wiring configuration, thus resulting in adapters 10', 10", 10'", etc. being created. Each of 10, 10', 10", 10'", etc. comprise unique electrical configurations. Those skilled in the art will appreciate that the number of possible cross-wiring configurations is equivalent to the factorial of the number of conductors. For example, in an eight wire adapter, the total possible cross-wiring configurations is equal to 8!, which is 40,320 possible cross-wire configurations.

Although the plug, socket, and cross-wiring of the present invention can comprise distinct and individual portions of an adapter, they are most preferably combined into a single small and compact unit. In an embodiment of the present invention, the external housing of the adapter can comprise a single injection molded housing which contains a plug, socket, and cross-wiring section. The cross-wiring section may be separate from or incorporated into the plug and/or socket sections.

In one embodiment of the present invention, an RJ-45 eight-wire plug and an RJ-45 eight-wire socket are used in conjunction with a cross-wiring section disposed therebetween. Within adapters 10, 10', 10", 10'" of the present invention, the standard pin-outs for plugs 12 and sockets 14 are changed due to the different electrical configurations of cross-wirings 16, 16', 16", and 16'".

In one embodiment, an adapter of the present invention is preferably inserted directly into a patch panel, leaving the socket of the adapter exposed to receive a standard network cable to be connected to a switch or other network appliance. Because the adapter of the present invention preferably changes the pin-outs from a standard to a non-standard wiring pattern, a computer or other electronic device cannot communicate successfully with the network appliance without a second adapter of the present invention which has a cross-wiring section that corresponds to the cross-wiring section of the first adapter, inserted into the network card of the computer or other electronic device, or at the wall socket to which the computer or other electronic device is connected. In this embodiment, if the second adapter is inserted into a wall jack, then the first and second adapters are disposed in a front-to-front configuration and the cross-wiring sections of the first and second adapters can be of an identical configuration.

Figure 5A:
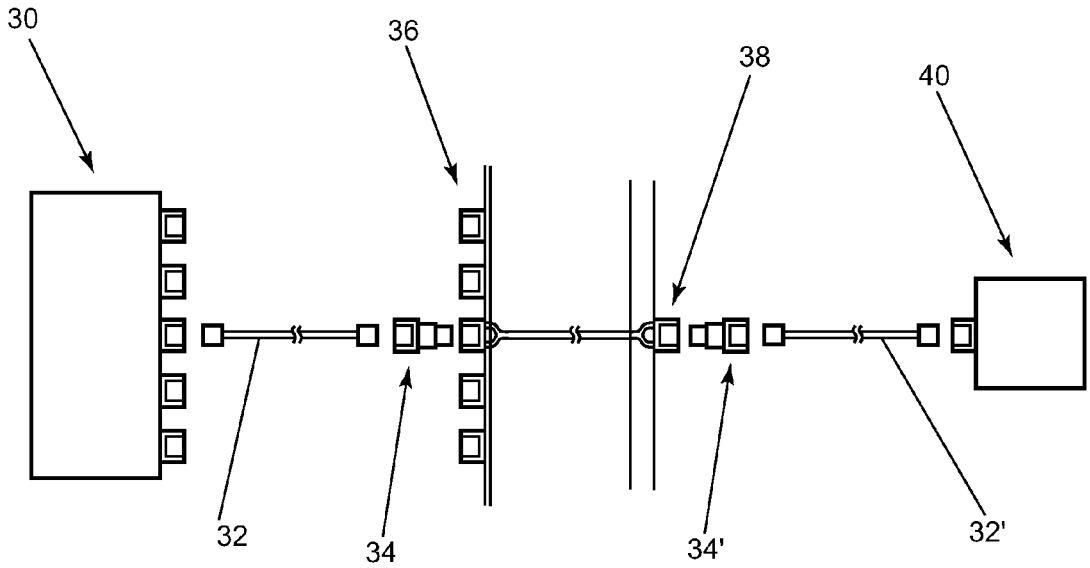
FIGS. 5A and 5B are drawings which schematically illustrate adapters of the present invention connected in a front-to-front and a back-to-back arrangement respectively.

FIG. 5A illustrates one possible front-to-front configuration. As illustrated therein, switch or other network appliance 30 preferably connects to standard cable 32 which connects to a socket of first adapter 34 of the present invention which is inserted into patch panel 36. Patch panel 36, preferably connects to wall jack 38 which has a plug of second adapter 34' inserted therein. Standard cable 32' then preferably connects second adapter 34' to computer or other electronic device 40.

Figure 5B:
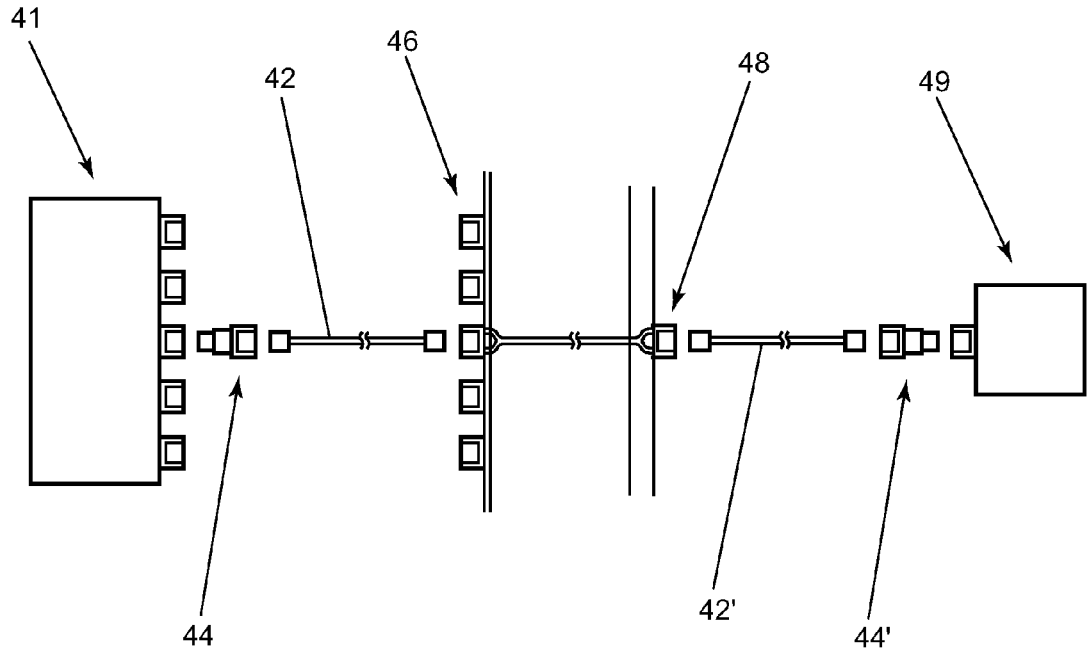

FIG. 5B illustrates another embodiment of the present invention, wherein first and second adapters are arranged in a back-to-back configuration, as illustrated therein, first adapter 44 of the present invention is preferably inserted directly into switch or other network appliance 41, leaving the socket of first adapter 44 exposed to receive standard network cable 42 for connection to patch panel 46. In this embodiment, patch panel 46 preferably connects to one or more wall jacks 48 which in turn connect, via standard cable 42' to a socket of second adapter 44'. A plug of second adapter 44' preferably inserts into computer or other electronic device 49. In this embodiment, first and second adapters 44 and 44' are disposed in a back-to-back arrangement and because of this arrangement, the cross-wiring sections of the first and second adapters 44 and 44' can be of an identical configuration.

In the foregoing embodiment, wherein the second adapter is connected to the wall or socket to which the computer or other electronic device is connected, the second adapter preferably has a cross-wiring configuration which is the inverse of the adapter that is connected to the computer or other electronic device.

Figure 6:
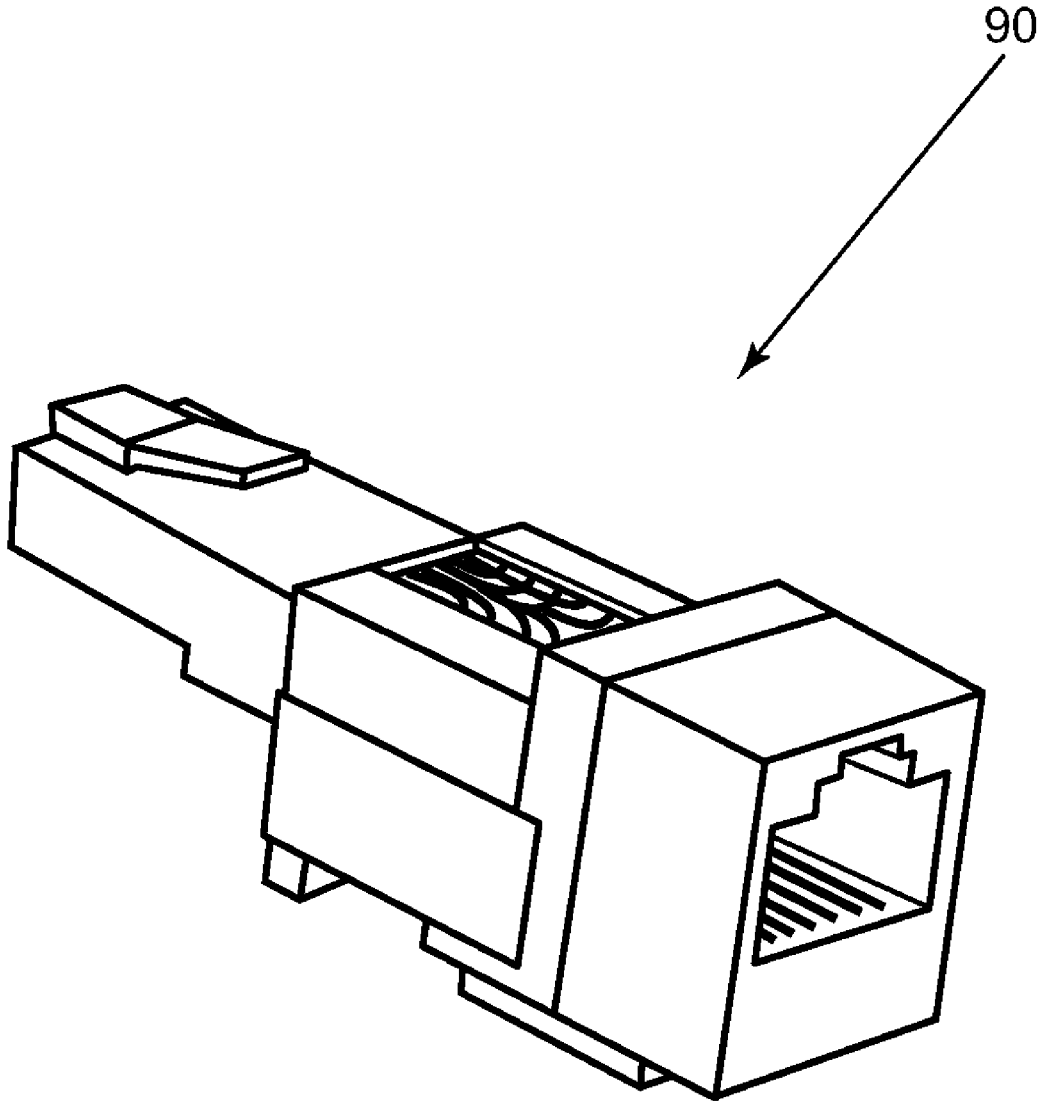
FIG. 6 is a perspective view drawing illustrating an embodiment of the adapter of the present invention.

FIG. 6 is a perspective view drawing of adapter 90 of an embodiment of the present invention.

Figure 7:
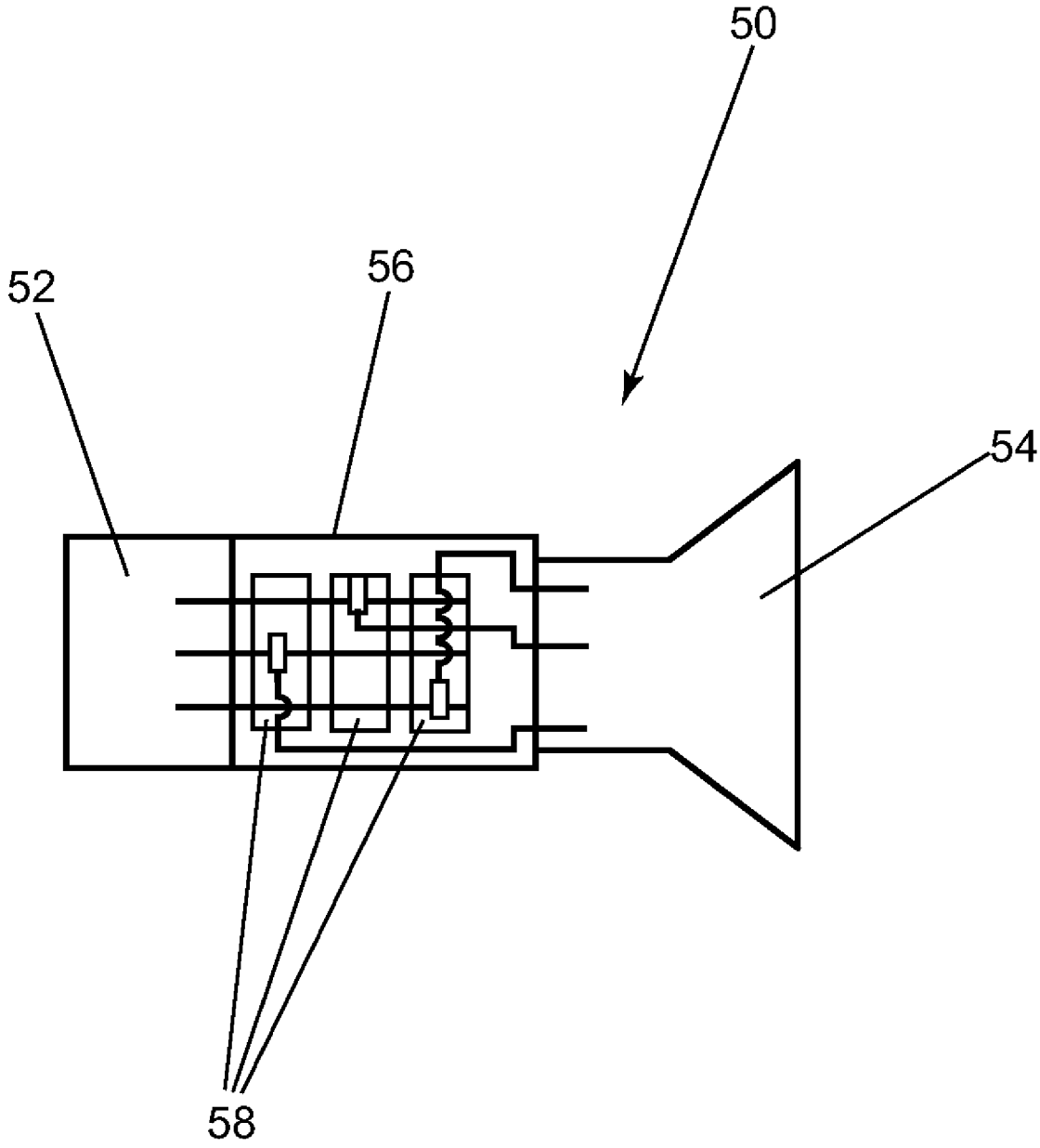
FIG. 7 is a drawing illustrating an embodiment of the present invention wherein selector switches are used to achieve a cross-wiring function.

As illustrated in FIG. 7, an alternative embodiment of the present invention provides adapter 50 with plug 52 and socket 54 wherein cross-wiring 56 comprises a plurality of selector switches 58. In this embodiment, a user can independently select the cross-wiring combination for adapter 50. As such, a single adapter can be provided which can be adjusted by a user to provide every possible cross-wiring connection combination. For example, if adapter 50 is to be compatible with an RJ-45 eight-wire plug and socket configuration, eight switch blocks are preferably provided and each switch block preferably comprises eight independent single pole single throw switches or an 8 position selector switch. Thus, the connection combination for a controlled network can be changed on a routine or random basis and approved users can be issued the appropriate connection codes/combinations.

Figure 8A:
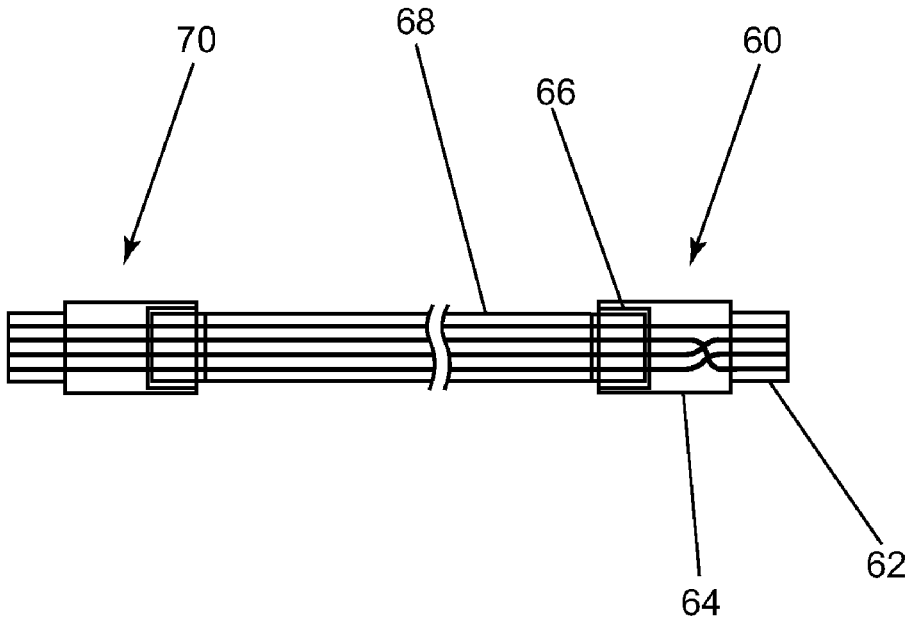
FIG. 8A is a drawing which illustrates an embodiment of the present invention wherein an adapter of the present invention is connected to a first end of a cable which can have a standard connector attached to a second end of the cable.

In an embodiment of the present invention, as illustrated in FIG. 8A, adapter 60 can have plug 62 connected to cross-wiring section 64, which connects to socket 66. In this embodiment, socket 66 is preferably designed to receive one or more conductors of cable 68. In this embodiment of the present invention, cross-wiring section 64 is preferably but not necessarily integrally incorporated into plug 62 and socket 66 of adapter 60. In a sub embodiment thereof, cable 68 is preferably connected to socket 66. Cable 68 can have one or more standard and/or common connectors 70 attached to its distal end, thus resulting in a patch cable with a modified wiring pattern being provided.

Figure 8B:
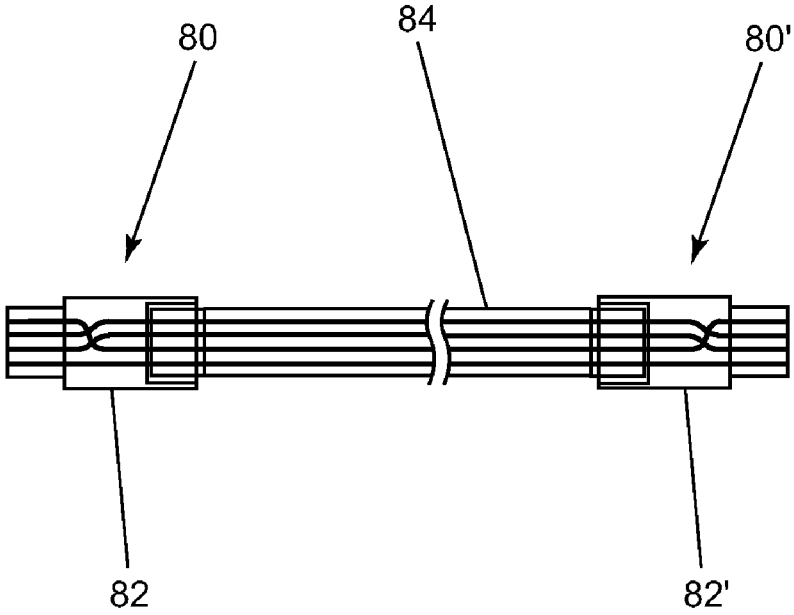
FIG. 8B is a drawing which illustrates an embodiment of the present invention wherein two identical non-symmetrical wiring patterns are disposed in a back-to-back manner such that the wiring pattern going into a first end is rendered at the second end.

FIG. 8B illustrates a pair of adapters 80 and 80' having identical non-symmetrical cross-wiring configurations 82 and 82' respectively. Adapter 80 is preferably disposed at a first end cable 84, and adapter 80' is preferably disposed at a second end of cable 84. First and second adapters 80 and 80' are thus disposed in a back-to-back configuration. Accordingly, a wiring configuration from a first end of this setup is re-constructed at the second end. The length of cable 84 in this embodiment is preferably comprised of a plurality of lengths of cable, each of which preferably have standard connectors disposed at terminal ends thereof. In addition, in this embodiment, one or more connectors typically used in networks can intentionally be wired in a configuration which is different from a standard or common wiring configuration. For example, as best illustrated in FIG. 5A, network appliance 30 and/or patch panel 36 can optionally have one or more of the connectors which are incorporated therein wired in a configuration which is different from a standard or common configuration.

In another embodiment of the present invention, one or more of the adapters of the present invention can optionally comprise a visible identifier, including but not limited to color coding, numerical coding, other visual coding, and/or a combination thereof to assist a user in identifying an adapter. (See for example Visual Identifier 90 FIG. 6).

Embodiments of the present invention preferably eliminate communication with a controlled network by a computer or other electronic device that is attached to the controlled network without the use of the corresponding inverse adapter or combination of adapters of the present invention. Embodiments of the present invention also preferably prevent an unauthorized user from being able to connect to the network without the correct adapter and/or correct combination of adapters. Examples of networks that can especially benefit from the present invention include government controlled networks, hospitals, libraries, colleges, industrial and commercial networks.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A network security apparatus comprising:

a first adapter connected to a first end of a network, the network having a standard or predetermined wiring pattern, said first adapter comprising:

first and second connecting ends; and a cross-wiring section which alters a wiring configuration from the standard or predetermined wiring pattern of the network and which causes a wiring pattern of said first connecting end to be altered from that of said second connecting end thereby altering the wiring pattern of the network; and a second adapter connected to a second end of the network, the second adapter comprising:

first and second connecting ends; and a cross-wiring section which is an inverse of the cross-wiring section of said first adapter thereby rendering a network connection having the standard or predetermined wiring pattern.

2. The apparatus of claim 1 wherein said first adapter is disposed between the network and an element selected from the list consisting of a switch, and a patch panel.

3. The apparatus of claim 1 wherein said first adapter is disposed between a first computer or other electronic device and the network and said second adapter is disposed between a second computer or other electronic device and the network.

4. The apparatus of claim 1 wherein said connecting ends of said first adapter are of a same connector series.

5. The apparatus of claim 1 wherein said connecting ends of said first adapter are not of a same connector series.

6. The apparatus of claim 1 wherein said first adapter comprises a visible identifier.

7. A method for enhancing the security of a network comprising:

altering a wiring pattern of a network at a first end of the network from a standard or predetermined wiring pattern to a non-standard or non-predetermined wiring pattern with a first removable adapter comprising a cross-wiring section; and altering a wiring pattern at a second end of the network from the non-standard or non-predetermined wiring pattern to a standard or predetermined wiring pattern with a second removable adapter comprising a cross-wiring section which is an inverse of the cross-over section of the first adapter.

8. The apparatus of claim 1 wherein at least one of said connecting ends of said first adapter comprises a socket.

9. The apparatus of claim 1 wherein at least one of said connecting ends of said first adapter comprises a plug.

10. The apparatus of claim 1 wherein at least one of said connecting ends of said second adapter comprises a socket.

11. The apparatus of claim 1 wherein at least one of said connecting ends of said second adapter comprises a plug.

12. The apparatus of claim 1 wherein said cross-wiring section of said first adapter comprises a user-selectable cross-wiring section.

13. The apparatus of claim 1 wherein said cross-wiring section of said second adapter comprises a user-selectable cross-wiring section.

* * * * *